US008380113B2

(12) United States Patent
Natori et al.

(10) Patent No.: US 8,380,113 B2
(45) Date of Patent: Feb. 19, 2013

(54) FIXING MEMBER, AND FIXING DEVICE AND IMAGE FORMING APPARATUS USING SAME

(75) Inventors: Junichiro Natori, Yokohama (JP); Tsuneaki Kondoh, Ayase (JP); Tomoaki Sugawara, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 445 days.

(21) Appl. No.: 12/590,782

(22) Filed: Nov. 13, 2009

(65) Prior Publication Data

US 2010/0129123 A1 May 27, 2010

(30) Foreign Application Priority Data

Nov. 21, 2008 (JP) ..... 2008-298826
May 20, 2009 (JP) ..... 2009-122424

(51) Int. Cl.
*G03G 15/20* (2006.01)

(52) U.S. Cl. ..... 399/330; 399/399; 399/320

(58) Field of Classification Search ..... 399/320, 399/313, 330, 331
See application file for complete search history.

(56) References Cited

U.S. PATENT DOCUMENTS

| | | | |
|---|---|---|---|
| 6,911,240 | B2 | 6/2005 | Kondoh |
| 7,146,126 | B2 | 12/2006 | Yoshii et al. |
| 7,539,450 | B2 | 5/2009 | Aze et al. |
| 7,558,520 | B2 | 7/2009 | Sugawara et al. |
| 2004/0224165 | A1 | 11/2004 | Kondoh et al. |
| 2005/0095381 | A1 | 5/2005 | Kondoh |
| 2006/0198666 | A1 | 9/2006 | Kondoh et al. |
| 2008/0063444 | A1 | 3/2008 | Kondoh et al. |
| 2009/0003903 | A1 | 1/2009 | Katano et al. |

FOREIGN PATENT DOCUMENTS

| | | |
|---|---|---|
| JP | 2005-292218 | 10/2005 |
| JP | 2006-018173 | 1/2006 |
| JP | 2006-133576 | 5/2006 |
| JP | 2008-191557 | 8/2008 |
| JP | 2008-197585 | 8/2008 |

OTHER PUBLICATIONS

Sugawara Fixing device and image forming apparatus 2008-191557 English machine translation.*
Sugawara heating memmber, heating roller, fixing device, image forming apparaus and metho for manufacturing heating member 2008-197585 English machine translation.*

* cited by examiner

*Primary Examiner* — Walter L Lindsay, Jr.
*Assistant Examiner* — Roy Y Yi
(74) *Attorney, Agent, or Firm* — Cooper & Dunham LLP

(57) ABSTRACT

A fixing member including a substrate and an elastic layer provided on a surface of the substrate. The elastic layer includes a fluorosilicone rubber including carbon fibers and voids.

10 Claims, 3 Drawing Sheets

FIXING MEMBER, AND FIXING DEVICE AND IMAGE FORMING APPARATUS USING SAME

BACKGROUND OF THE INVENTION

1. Field of the Invention

The present invention relates to a fixing member. In addition, the present invention also relates to a fixing device and an image forming apparatus using the fixing member.

2. Discussion of the Related Art

The mainstream of electrophotographic image forming apparatuses such as copiers and printers are switching from monochrome to full-color recently. A typical full-color electrophotographic image forming apparatus includes an image forming part that forms a full-color toner image comprising cyan, magenta, yellow and black toner images on a recording medium, and a fixing device that fixes the full-color toner image on the recording medium. The fixing device includes a heating device that heats a toner image on a recording medium, a fixing member that fixes the toner image on the recording medium, and a pressing member that forms a fixing nip between itself and the fixing member. When a recording medium having a toner image thereon passes through the fixing nip, heat and pressure are applied to the toner image, thereby fixing the toner image on the recording medium.

Belt-shaped and roller-shaped fixing members are widely used so far. For example, a substrate such as a metallic roller or a resin seamless belt on which an elastic layer made of a heat-resistant rubber, etc. is provided, and that on which a release layer is further provided on the elastic layer have been widely used as fixing members. A roller-shaped fixing member may be integrated with a heating device. The resulting heating fixing roller may include a heating device interiorly. A belt-shaped fixing member may also be integrated with a heating device. In this case, the heating device may be provided in the interior of the seamless belt stretched taut by rollers.

Fixing members are supposed to evenly heat a full-color toner image which generally comprises four color toner images. Therefore, fixing members are required to flexibly and intimately contact toner images to effectively transmit heat thereto. To respond to this requirement, silicone rubbers are widely used for fixing members because of having both flexibility and heat resistance. However, since silicone rubbers have low thermal conductivity, the speed of heat conduction to toner images may be low. When heat is conducted slowly, it may take a long time until the surface of a fixing member is heated to a temperature sufficient to fix toner images. In particular, with regard to high-speed image forming apparatuses, sufficient heat may not be supplied to toner images within an appropriate time. Additionally, warm-up time of image forming apparatuses may also be lengthened because warm-up speed of fixing members generally controls that of image forming apparatuses.

In attempting to solve the above-described problem, Japanese Patent Application Publication No. (hereinafter JP-A) 2005-292218 and JP-A 2006-133576 disclose fixing members having an elastic layer including a silicone rubber. The silicone rubber contains a filler having high thermal conductivity, such as aluminum nitride and a high-density carbon fiber, to improve thermal conductivity of the elastic layer. This approach advantageously increases the heat supply speed on the one hand, but disadvantageously increases the specific density of the fixing member on the other. As a result, heat capacity of the fixing member may be so large that warm-up time may not be shortened.

JP-A 2008-191557 and JP-A 2008-197585 disclose fixing members having an elastic layer including a silicone rubber, carbon fibers and voids, and a release layer including a fluorine-based resin on the outermost surface. Advantageously, fluorine-based resins have excellent releasability from toner owing to their low surface energy and nonadhesive property. At the same time, fluorine-based resins have high hardness. Therefore, when heat and pressure are applied to toner particles at a fixing nip to fix them on a recording medium, the toner particles may be excessively compressed, which results in deterioration of the resultant image resolution. Additionally, such an elastic layer with high hardness may not precisely follow roughness of the surface of a recording medium, which results in unevenness of the resultant image.

JP-A 2006-18173 further discloses a fixing member having a rubber-made elastic layer having both flexibility and toner releasability. However, this fixing member still has not solved the problem of thermal conduction.

SUMMARY OF THE INVENTION

Accordingly, exemplary embodiments of the present invention provide a fixing member which has high toner releasability and short warm-up speed. In addition, exemplary embodiments of the present invention provide a fixing device and an image forming apparatus which produce high quality images.

These and other features and advantages of the present invention, either individually or in combinations thereof, as hereinafter will become more readily apparent can be attained by exemplary embodiments described below.

One exemplary embodiment provides a fixing member including a substrate and an elastic layer provided on a surface of the substrate. The elastic layer includes a fluorosilicone rubber including carbon fibers and voids.

Another exemplary embodiment provides a fixing device configured to fix a toner image on a recording medium, which includes the above fixing member and a pressing member pressed against the fixing member.

Yet another exemplary embodiment provides an image forming apparatus which includes a toner image forming device configured to form a toner image and the above fixing device.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1A:
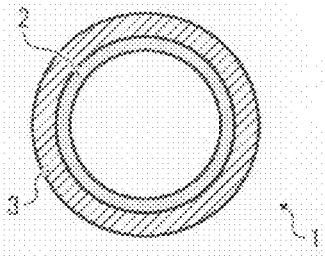
FIG. 1A is a cross-sectional schematic view illustrating an embodiment of the fixing member of the present invention including a substrate and an elastic layer.

Exemplary embodiments of the present invention provide a fixing member for fixing toner images on a recording medium in electrophotographic image forming apparatuses. The fixing member includes a substrate and an elastic layer provided on a surface of the substrate. The elastic layer includes a fluorosilicone rubber including carbon fibers and voids. Such a fixing member shortens warm-up time of image forming apparatuses. Besides, such a fixing member provides high quality images. The fixing member may further include a release layer on its outermost surface. The release layer may include a fluorosilicone rubber including no carbon fiber and no void. Such a release layer provides the fixing member with smoothness and flexibility, thereby providing high quality images regardless of the kind of recording medium. The fixing member may be roller-shaped, belt-shaped, or sheet-shaped, for example, but the shape of the fixing member is not limited thereto.

The fluorosilicone rubber in the elastic layer and the release layer may include rubber components other than fluorosilicone, such as dimethylsilicone. However, from the viewpoint of releasability, neither the fluorosilicone rubber in the elastic layer nor that in the release layer preferably includes a rubber component other than fluorosilicone.

The fluorosilicone rubber in the elastic layer and the release layer may be either a narrowly-defined fluorosilicone rubber consisting of fluoro-organosiloxane units only or a broadly-defined fluorosilicone rubber including fluoro-organosiloxane units and other units. Fluorosilicone rubbers having voids provide fixing members with flexibility and releasability as well as fluorine-based resins. Such fixing members produce high quality images regardless of the kind of recording medium.

The carbon fibers serve as heat conducting paths in the elastic layer. Because of having the carbon fibers and voids, the elastic layer itself has a low heat capacity and can be quickly heated. Therefore, warm-up time of the fixing member is short.

By providing the release layer including a fluorosilicone rubber including no carbon fiber and no void on the elastic layer, the outermost surface of the fixing member is more smoothened without deteriorating flexibility. Such a fixing member produces much higher quality images regardless of the kind of recording medium. Since both of the elastic layer and the release layer include fluorosilicone rubbers, adhesiveness between the layers is good.

The carbon fibers form highly thermally conductive paths surrounding voids in the elastic layer. As a result, thermal conductivity of the fixing member improves, keeping the temperature of the fixing member constant even at high-speed fixing. Accordingly, warm-up time of a fixing device including the fixing member may also be shortened. To improve thermal conductivity much more, it is preferable that the carbon fibers, which are highly thermally conductive fillers, may be brought into more intimate contact with each other. Obviously, the carbon fibers are brought into intimate contact when the fixing member deforms upon application of pressure at a fixing nip, thereby increasing thermal conductivity. Namely, thermal conductivity of the fixing member is variable. Specific examples of usable carbon fibers include, but are not limited to, pitch-based carbon fibers and PAN-based carbon fibers, and pitch-based carbon fibers are preferable.

The void ratio of the elastic layer is preferably from 15 to 85%. When the void ratio is too small, heat capacity of the elastic layer is so large that warm-up speed of a fixing device may be too long. Further, flexibility of the elastic layer may be poor. When the void ratio is too large, the elastic layer may have poor strength and elasticity. Further, it is likely that voids are formed at the surface of the elastic layer, Toughening the surface of the elastic layer. As a result, high quality images may not be provided. The void ratio $\epsilon$ (%) is defined by the following equation (1):

$$\epsilon=\{(\rho 2-\rho 1)/\rho 2\}\times 100 \quad (1)$$

wherein $\rho 1$ represents a specific gravity of an entire material including voids and $\rho 2$ represents a specific gravity of the matrix of the material excluding the voids.

The ten point height Rz (μm) of roughness profile of the outermost surface of the fixing member, which contacts a recording medium during fixing operation, is preferably smaller than the volume average particle diameter (μm) of toner. In this case, the toner may not get into concave portions on the outermost surface, suppressing deterioration of the resulting image quality. The ten point height Rz (μm) of roughness profile is measured according to a method based on JIS (Japanese Industrial Standard) B0601:1994.

In particular, the ten point height Rz (μm) of roughness profile of the outermost surface of the fixing member is preferably 5 μm or less. When Rz is greater than 5 μm, gloss of the resulting image may be uneven. Rz can be improved when the release layer is formed on the elastic layer.

A fixing device including the above fixing member and an image forming apparatus including the fixing device also have the same advantages as the fixing member. Namely, the fixing device and the image forming apparatus also have good toner releasability and short warm-up time and provide high quality images.

Accordingly, exemplary embodiments of the present invention provide a fixing member which has high toner releasability and short warm-up speed, and a fixing device and an image forming apparatus which produce high quality images.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

For the sake of simplicity, the same reference number will be given to identical constituent elements such as parts and materials having the same functions and redundant descriptions thereof omitted unless otherwise stated.

(Embodiment 1)

Figure 1B:
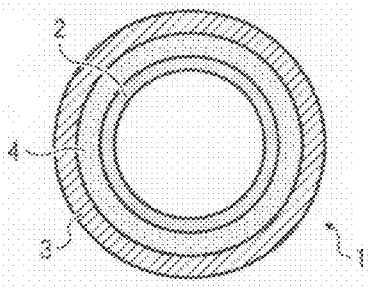
FIG. 1B is a cross-sectional schematic view illustrating an embodiment of the fixing member of the present invention including a substrate, an elastic layer, and an intermediate layer between the substrate and the elastic layer.

FIGS. 1A and 1B are cross-sectional schematic views illustrating an embodiment 1 of the fixing member of the present invention. A fixing member 1 illustrated in FIG. 1A includes a substrate and an elastic layer, and is roller-shaped. Exemplary embodiments of the fixing member may be roller-shaped, belt-shaped, or sheet-shaped, for example. Referring to FIG. 1A, the fixing member 1 includes a substrate 2 and an elastic layer 3 including a fluorosilicone rubber including carbon fibers and voids. The elastic layer 3 is formed on a primer layer, not shown, that is formed on a surface of the substrate 2. The elastic layer 3 preferably has a thickness of from 0.1 to 4 mm, more preferably from 0.5 to 2 mm. When the thickness is too small, the resulting fixing nip may be too narrow. When the thickness is too large, thermal conductivity may decrease and heat capacity may increase. As a result, printing speed and warm-up speed of image forming apparatuses may be lengthened.

Referring to FIG. 1B, a fixing member 1 includes a substrate 2, an elastic layer 3, and an intermediate layer 4 between the substrate 2 and the elastic layer 3. As long as a surface of the fixing member 1 which contacts toner images and recording media is comprised of a fluorosilicone rubber including carbon fibers and voids, the fixing member 1 may include the intermediate layer 4 which is comprised of different materials from the elastic layer 3. When the intermediate layer 4 has an appropriate elasticity, the elastic layer 3 comprising a fluorosilicone rubber including carbon fibers and voids can be more thinned than as illustrated in FIG. 1A. The intermediate layer 4 may be an elastic layer, and is preferably comprised of materials having good thermal conductivity and small heat capacity. Specific preferred materials usable for the intermediate layer 4 include, but are not limited to, dimethylsilicone rubbers, methylphenylsilicone rubbers, and fluorosilicone rubbers. From the viewpoint of adhesiveness to the elastic layer 3, fluorosilicone rubbers are preferable.

Figure 2A:
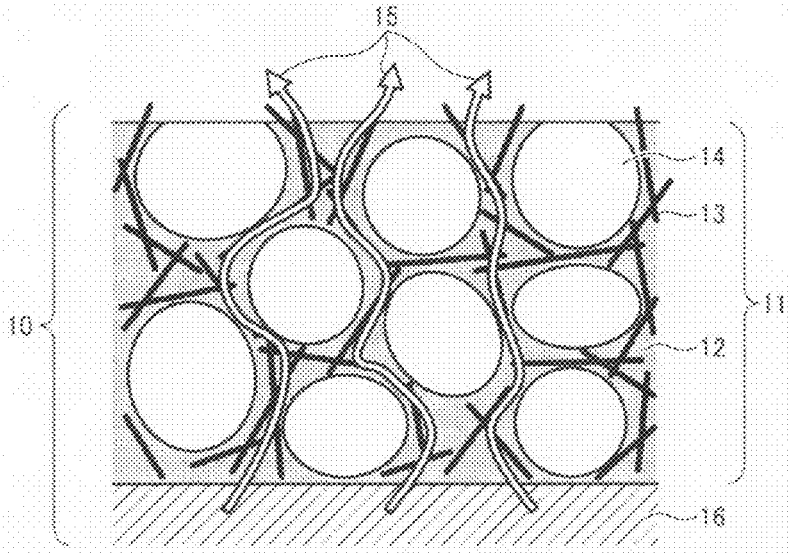
FIG. 2A is a schematic view illustrating heat conduction in the fixing member illustrated in FIG. 1A, in which carbon fibers are exposed at the surface.
Figure 2B:
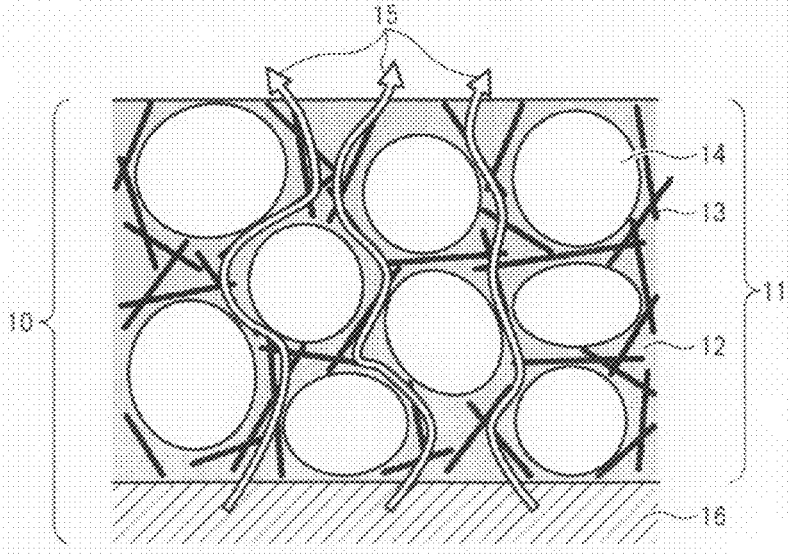
FIG. 2B is a schematic view illustrating heat conduction in the fixing member illustrated in FIG. 1A, in which no carbon fiber is exposed at the surface.

FIGS. 2A and 2B are schematic views illustrating fine structures and heat conduction in the fixing member illustrated in FIG. 1A. A fixing member 10 includes a substrate 16 and an elastic layer 11 formed on the substrate 16. The elastic layer 11 includes a fluorosilicone rubber 12 including carbon fibers 13 and voids 14. The voids 14 may be either independent voids or continuous voids. In a case in which the elastic layer 11 is abraded to control the outer diameter of the fixing member 10, it is likely that the carbon fibers 13 and the voids 14 are exposed at the outermost surface of the elastic layer 11, as illustrated in FIG. 2A. In order to smooth the outermost surface of the fixing member, for the purpose of reducing unevenness of the resulting image, it is preferable that neither carbon fiber 13 nor void 14 is exposed at the outermost surface of the elastic layer 11, as illustrated in FIG. 2B. It is likely the elastic layer 11 has the structure as illustrated in FIG. 2B unless the surface of the elastic layer 11 is subjected to abrasion. Accordingly, it is preferable to take the outer diameter of the fixing member into consideration at the time the elastic layer 11 is formed.

Since the carbon fibers 13 have better thermal conductivity than the fluorosilicone rubber 12 and the voids 14, the elastic layer 11 has good thermal conductivity as a whole. Additionally, since the carbon fibers 13 are become oriented along the voids 14, the short carbon fibers 13 are brought into contact with each other and form heat conducting paths. The heat conducting paths effectively conduct heat from the substrate 16 side to the outer surface of the elastic layer 11. Curved arrows 15 in FIGS. 2A and 2B represent typical flows of heat. To improve thermal conductivity, the elastic layer 11 preferably includes the carbon fibers 13 in an amount of from 1 to 50 parts by weight, and more preferably from 5 to 40 parts by weight, based on 100 parts by weight of the fluorosilicone rubber 12. When the amount of the carbon fibers 13 is too small, thermal conductivity may not be improved. When the amount of the carbon fibers 13 is too large, the voids 14 may not sufficiently provide the elastic layer 11 with elasticity, and the cost may increase. Because of having high elastic modulus, the carbon fibers 13 strengthen the elastic layer 11 and reduce the compression set of the elastic layer 11, which results in a long lifespan of the elastic layer 11. The carbon fibers 13 may be either pitch-based carbon fibers or PAN-based carbon fibers, and pitch-based carbon fibers are more preferable because of having high thermal conductivity.

The voids 14 provide the fluorosilicone rubber 12 including the carbon fibers 13 with elasticity, and reduce heat capacity of the elastic layer 11. The voids 14 are defined as spaces containing a gas such as air and nitrogen. The heat capacity of the void 14 is extremely smaller compared to those of the fluorosilicone rubber 12 and the carbon fiber 13. Therefore, as the ratio of the voids 14 in the elastic layer 11 increases, heat capacity of the elastic layer 11 decreases, resulting in short warm-up time of a fixing device including the fixing member. The warm-up time is defined as the time required for a fixing device to heat a fixing member to a temperature sufficient to fix toner images after the fixing device is powered on.

The ratio of the voids 14 in the elastic layer 11, hereinafter referred to as the void ratio, is preferably from 15 to 85%. When the void ratio is too small, heat capacity of the elastic layer 11 may not be sufficiently reduced or elasticity thereof may not be sufficient. When the void ratio is too large, strength and stiffness of the elastic layer 11 may be poor.

The fluorosilicone rubber 12 is preferably comprised primarily of a fluoro-organosiloxane unit, more preferably a fluoro-organosiloxane unit having the following formula (1):

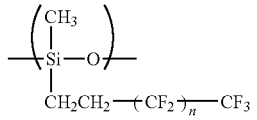

(1)

wherein n represents an integer of from 0 to 20.

The fluorosilicone rubber 12 may optionally include additives such as a filler, an antioxidant, a colorant, a plasticizer, a wax, and an oil, if needed. The fluorosilicone rubber 12 may further include organosiloxane units having the following formula (2) or (3) other than the fluoro-organosiloxane unit having the following formula (1):

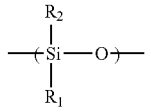

(2)

wherein each of $R_1$ and $R_2$ independently represents an unsubstituted or substituted monovalent hydrocarbon group having no aliphatic unsaturated bond, preferably having 1 to 8 carbon groups. Specific examples of such groups include an alkyl group, a cycloalkyl group, and an aryl group. Among these groups, methyl group, ethyl group, and phenyl group are preferable;

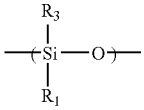

(3)

wherein $R_1$ is the same as $R_1$ in the formula (2); and $R_3$ represents a monovalent aliphatic unsaturated hydrocarbon group. Specific examples of such groups include alkenyl groups having 2 to 3 carbon atoms, such as vinyl group, allyl group, and ethynyl group. Among these groups, vinyl group is preferable.

Polyorganosiloxane having the above fluoro-organosiloxane units are used as raw materials for the fluorosilicone rubber 12. Such polyorganosiloxanes may be either millable-type or liquid-type. From the viewpoint of molding, liquid-type polyorganosiloxanes are preferable.

The carbon fiber 13 may be obtained by carburizing a precursor which is a fibrous raw material. The elastic modulus, strength, and thermal conductivity of the carbon fiber are variable by varying production conditions. Specific examples of commercially available pitch-based carbon fibers include, but are not limited to, GRANOC® Milled Fibers XN-100-05M (50 μm) and XN-100-15M (150 μm) (from Nippon Graphite Fiber Corporation). Specific examples of commercially available PAN-based carbon fibers include, but are not limited to, TORAYCA® Milled Fibers MLD-30, MLD-300, and MLD-1000 (from Toray Industries, Inc.), and PYROFIL® Chopped Fibers (from Mitsubishi Rayon Co., Ltd.). Pitch-based carbon fibers generally have a thermal conductivity of about 500 W/mK. PAN-based carbon fibers generally have a thermal conductivity of about 50 W/mK at a maximum. Namely, thermal conductivity of pitch-based carbon fibers is more than 10 times that of PAN-based carbon fibers. Therefore, pitch-based carbon fibers are preferable for the elastic layer 11 to have good thermal conductivity.

The voids 14 are defined as spaces in the elastic layer 11 in which a gas exists. For example, the voids 14 may be bubbles formed by foaming agents; expanded expandable particles having a micro-capsule structure in which a low-boiling-point material core is contained in a thermoplastic material shell; or resin balloons or glass balloons having a predetermined size.

Specific examples of usable foaming agents include, but are not limited to, inorganic foaming agents such as sodium bicarbonate and ammonium bicarbonate; and organic foaming agents such as p,p'-oxybis(benzenesulfonylhydrazide), dinitrosopentamethylenetetramine, azodicarbonamide, and azobisisobutyronitrile. Water is also usable as a foaming agent. Specific examples of usable expandable particles include, but are not limited to, ADVANCELL® EM series (from Sekisui Chemical Co., Ltd.) which are expandable microspheres containing a liquid low-boiling-point hydrocarbon in an acrylonitrile resin shell; and Matsumoto Microsphere® F-series (from Matsumoto Yushi-Seiyaku Co., Ltd.). Specific examples of usable balloons include, but are not limited to, 3M™ Glass Bubbles (from Sumitomo 3M Limited) which are made of lime borosilicate glass, Shirasu balloons which are made of natural volcanic glass sediments, and Matsumoto Microsphere® F-DE-series and MFL-series (from Matsumoto Yushi-Seiyaku Co., Ltd.) which are made of acrylonitrile resins.

(Embodiment 2)

Figure 3A:
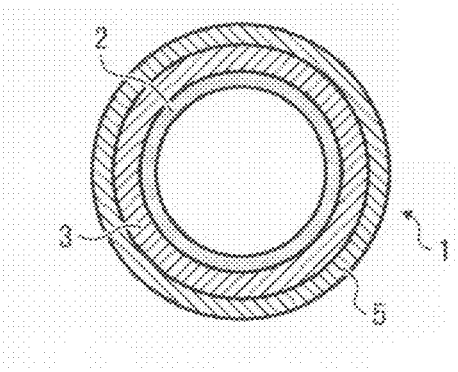
FIG. 3A is a cross-sectional schematic view illustrating an embodiment of the fixing member of the present invention including a substrate, an elastic layer, and a release layer.
Figure 3B:
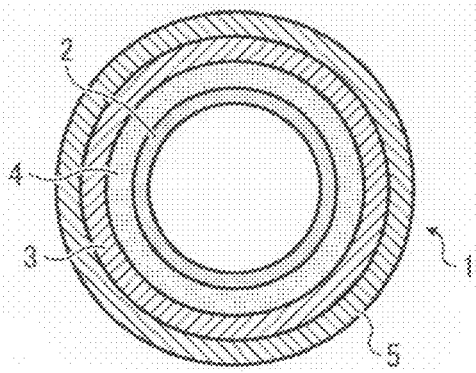
FIG. 3B is a cross-sectional schematic view illustrating an embodiment of the fixing member of the present invention including a substrate, an elastic layer, a release layer, and an intermediate layer between the substrate and the elastic layer.

FIGS. 3A and 3B are cross-sectional schematic views illustrating an embodiment 2 of the fixing member of the present invention. Referring to FIG. 3A, a fixing member 1 includes a substrate 2; an elastic layer 3 including a fluorosilicone rubber including carbon fibers and voids, formed on a primer layer, not shown, that is formed on a surface of the substrate 2; and a release layer 5 formed on a surface of the elastic layer 3. The release layer 5 includes a fluorosilicone rubber including no carbon fiber and no void. The release layer 5 preferably has a thickness of from 1 to 100 μm, more preferably from 10 to 100 μm. When the thickness is, too small, the release layer 5 may have poor durability and the surface of the fixing member 1 may not be smooth. When the thickness is too large, thermal conductive resistance may be disadvantageously large. The release layer 5 facilitates setting of the ten point height Rz (μm) of roughness profile of the elastic layer 3 to 5 μm or less.

As illustrated in FIG. 3B, an intermediate layer 4 may be formed between the substrate 2 and the elastic layer 3.

Preferred embodiments of the elastic layer 3 and the intermediate layer 4 in Embodiment 2 are the same as Embodiment 1.

Figure 4:
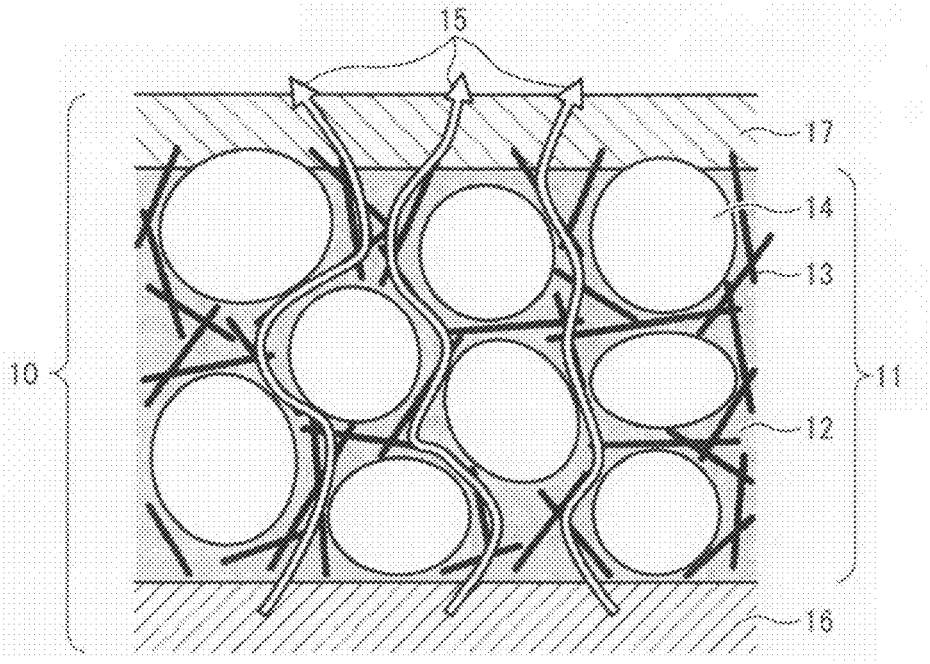
FIG. 4 is a schematic view illustrating heat conduction in the fixing member illustrated in FIG. 3A.

FIG. 4 is a schematic view illustrating heat conduction in the fixing member illustrated in FIG. 3A. A fixing member 10' includes a substrate 16, an elastic layer 11, and a release layer 17. The release layer 17 consists essentially of a fluorosilicone rubber 12. In other words, the release layer 17 substantially includes neither carbon fiber 13 nor void 14. Therefore, the fixing member 10' has good thermal conductivity and short warm-up speed. The release layer 17 covers a surface of the elastic layer 11 so as not to bring the carbon fibers 13 and the voids 14 into direct contact with toner images. Additionally, the release layer 17 makes the surface of the fixing member 10' smooth so as to improve toner releasability and offset resistance. Moreover, the release layer 17 brings the fixing member 10' into intimate contact with a recording medium following its surface profile. Accordingly, the fixing member 10' having the release layer 17 improves the resulting image quality.

(Embodiment 3)

Figure 5:
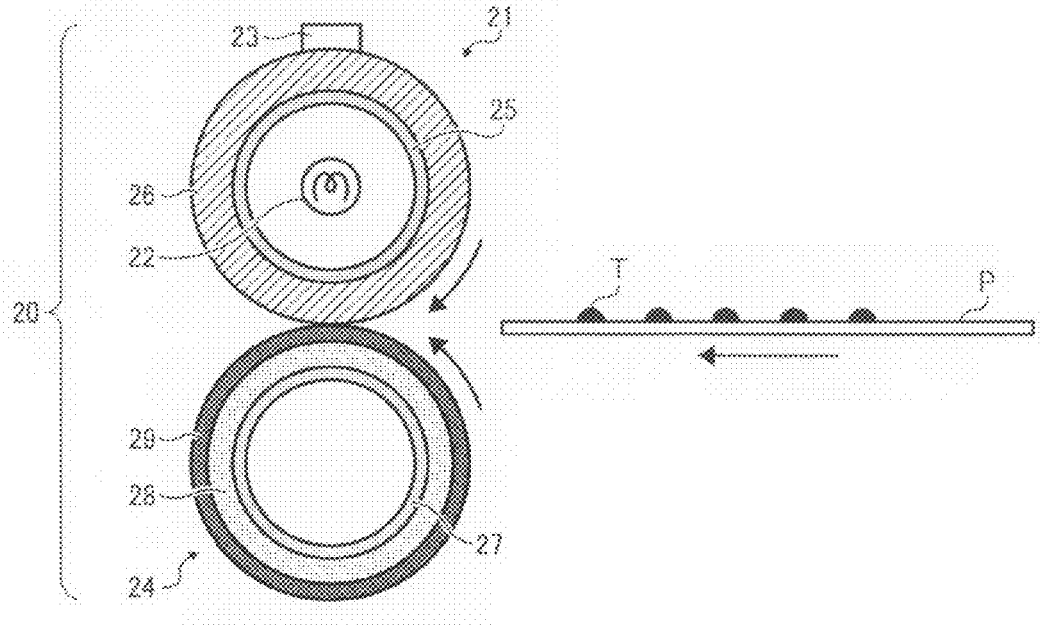
FIG. 5 is a schematic view illustrating an embodiment of the fixing device of the present invention.

Embodiment 3 of the present invention provides a roller fixing device including the fixing member described above. FIG. 5 is a cross-sectional schematic view illustrating an embodiment of the fixing device of the present invention. Referring to FIG. 5, a roller fixing device 20 includes a fixing roller 21, which is an embodiment of the present invention, and a halogen heater 22 provided inside the fixing roller 21. The fixing roller 21 is equipped with a temperature sensor 23. A pressing roller 24 is pressed against the fixing roller 21 so as to form a nip therebetween. A recording medium P having a toner image T thereon passes through the nip so that the toner image T is fixed on the recording medium P. The fixing roller 21 includes, in order from an innermost side thereof, a cored bar 25 and an elastic layer 26. The fixing roller 21 has the same configuration as Embodiment 1. The pressing roller 24 includes, in order from an innermost side thereof, a cored bar 27, an elastic layer 28 made of a heat-resistant rubber, and a release layer 29.

The roller fixing device 20 includes the fixing roller 21 which is identical to Embodiment 1. Accordingly, the fixing roller 21 provides good toner releasability and high quality images. The fixing roller 21 has good thermal conductivity sufficient to conduct heat from the halogen heater 22 to the surface of the elastic layer 26. Additionally, the fixing roller 21 has small heat capacity. Therefore, the fixing roller 21 has a short warm-up time and intimately contacts a recording medium following its surface profile. The pressing roller 24 includes the release layer 29 so as to prevent, toner offset in which toner particles are undesirably adhered to the pressing roller 24.

(Embodiment 4)

Figure 6:
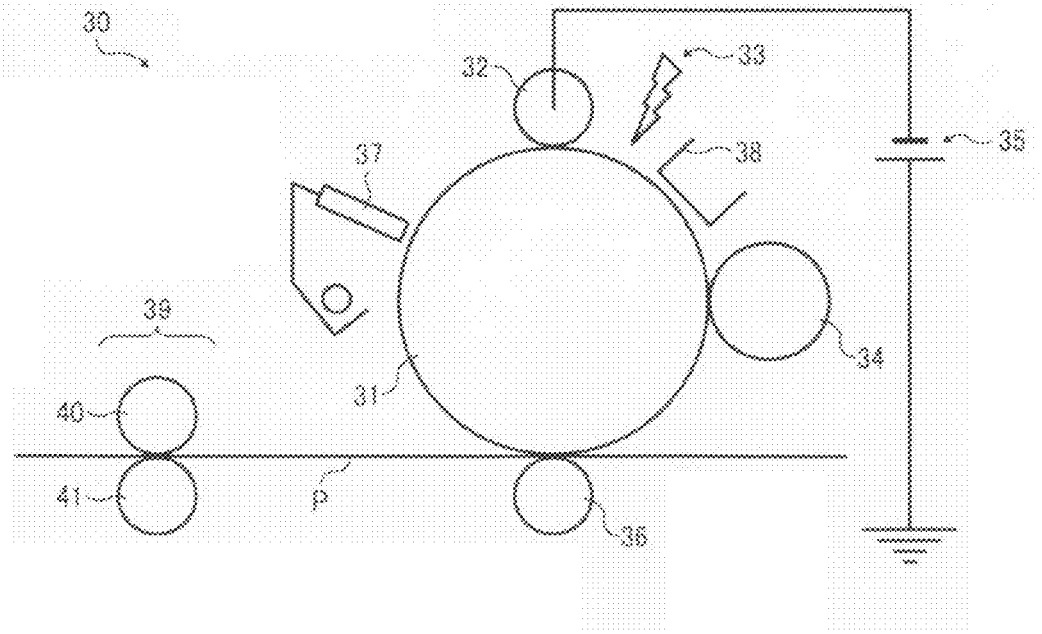
FIG. 6 is a schematic view illustrating an embodiment of the image forming apparatus of the present invention.

Embodiment 4 of the present invention provides an image forming apparatus including the fixing member described above. FIG. 6 is a schematic view illustrating an embodiment of the image forming apparatus of the present invention. Referring to FIG. 6, an image forming apparatus 30 includes an image forming part and a fixing device 39. The image forming part is configured to form a toner image and transfer the toner image onto a recording medium. The fixing device is configured to fix the toner image on the recording medium. The image forming part includes an image bearing member 31, a charging roller 32, an irradiator 33 such as a laser light beam source, a developing roller 34, a power source 35, a transfer roller 36, a cleaning device 37, and a surface potentiometer 38. The charging roller 32 charges the image bearing member 31 by contact therewith. Toner is adhered to an electrostatic latent image formed on the image bearing member 31 by the developing roller 34. The power source 35 applies a direct current voltage (DC) to the charging roller 32. The transfer roller 36 transfers a toner image from the image bearing member 31 onto a recording medium P. The cleaning device 37 cleans the image bearing member 31 after toner images are transferred therefrom. The surface potentiometer 38 measures the surface potential of the image bearing member 31. The fixing device 39, which is an embodiment of the present invention, includes a fixing roller 40 and a pressing roller 41.

In the image forming apparatus 30, a photosensitive layer of the image bearing member 31 is evenly charged by the charging roller 32 while the image bearing member 31 is rotating. Subsequently, the charged image bearing member 31 is irradiated with a laser light beam emitted from the irradiator 33 to form an electrostatic latent image thereon. A toner is adhered to the electrostatic latent image by the developing roller 34 to form a toner image. The toner image is then transferred onto a recording medium P. The recording medium P having the toner image thereon receives pressure at the nip between the fixing roller 40 and the pressing roller 41 in the fixing device 39, so that the toner image is pressed against the recording medium P while being softened by heat from the fixing roller 40. The recording medium P on which the toner image is fixed is discharged to a discharge part. The fixing roller 40 is an embodiment of the present invention. The fixing roller 40 may have a belt shape as an alternative.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Preparation of Fixing Roller)

A rubber composition including 100 parts of a two-liquid-type addition-hardening fluorosilicone rubber, 40 parts of a pitch-based carbon fiber XN-100-05M (from Nippon Graphite Fiber Corporation), and an appropriate amount of resin balloon F-80DE (from Matsumoto Yushi-Seiyaku Co., Ltd.) for controlling the void ratio of elastic layer is prepared. On a surface of an aluminum cored bar (roller-shaped substrate) having a thickness of 0.4 mm, the inner surface of which is strengthened with ring-like ribs, a silicone rubber primer is coated to have a thickness of 0.5 μm. The primer-treated cored bar is fixed to a mandrel and the above-prepared rubber composition is poured into a gap between a mold and the cored bar so that the resultant elastic layer has a thickness of 2 mm, followed by a primary vulcanization at 175° C. for 10 minutes and a secondary vulcanization at 200° C. for 4 hours. Thus, a fixing roller (1) having an elastic layer with a void ratio of 33% is prepared. The ten point height Rz (μm) of roughness profile (measured according to JIS B0601: 1994) of the fixing roller (1) is 4.6 μm.

(Evaluation of Toner Releasability)

The fixing roller (1) is mounted on the fixing unit of a commercially available image forming apparatus IMAGIO MF4570. A 100% black solid image with 600 dpi is formed with a toner from an image forming apparatus IMAGIO MP C4500 (from Ricoh Co., Ltd.), having a volume average particle diameter of 6.0 μm, on 10,000 sheets of an A4-size recycle paper MY RECYCLE PAPER GP (from Ricoh Co., Ltd.).

After the $10,000^{th}$ sheet is produced, the surface of the fixing roller (1) is visually observed to determine whether toner exists or not. Then a clean sheet of paper is passed through the fixing unit and visually observed to determine whether toner is transferred from the fixing roller (1) onto the clean sheet or not. The results are graded as follows.

A: Toner exists neither on the fixing roller nor the clean sheet.

B: Toner exists either on the fixing roller or the clean sheet.

C: Toner exists both on the fixing roller and the clean sheet.

(Evaluation of Image Quality)

The $10,000^{th}$ sheet of the solid image is visually observed to evaluate unevenness of gloss. The results are graded as follows.

A: Gloss is even.

B: Gloss is slightly uneven.

C: Gloss is uneven.

(Evaluation of Warm-Up Time)

The fixing roller (1) is mounted on the fixing unit of a commercially available image forming apparatus IMAGIO MF4570. After leaving the power off over night at room temperature, the fixing unit is powered on, and the time (sec) required to heat the surface of the fixing roller to 160° C. is measured. The fixing unit includes a 1,000-W halogen heater.

Example 2

The procedure in Example 1 is repeated except for changing the amount of the resin balloon F-80DE so that the void ratio of the elastic layer is changed from 33% to 17%. Thus, a fixing roller (2) is prepared. The fixing roller (2) is subjected to the same evaluations as the fixing roller (1) as described above.

Example 3

The procedure in Example 1 is repeated except that the conditions of the primary vulcanization are changed from at 175° C. for 10 minutes to at 130° C. for 5 minutes, and the fluorosilicone rubber used in Example 1 is coated on a surface of the rubber composition subjected to the primary vulcanization to have a thickness of 20 μm before the secondary vulcanization. Thus, a fixing roller (3) is prepared. The fixing roller (3) is subjected to the same evaluations as the fixing roller (1) as described above.

Example 4

The procedure in Example 3 is repeated except for changing the amount of the resin balloon F-80DE so that the void ratio of the elastic layer is changed from 33% to 50%. Thus, a fixing roller (4) is prepared. The fixing roller (4) is subjected to the same evaluations as the fixing roller (1) as described above.

Example 5

The procedure in Example 3 is repeated except for changing the amount of the resin balloon F-80DE so that the void ratio of the elastic layer is changed from 33% to 67%. Thus, a fixing roller (5) is prepared. The fixing roller (5) is subjected to the same evaluations as the fixing roller (1) as described above.

Example 6

The procedure in Example 3 is repeated except for changing the amount of the resin balloon F-80DE so that the void ratio of the elastic layer is changed from 33% to 75%. Thus, a fixing roller (6) is prepared. The fixing roller (6) is subjected to the same evaluations as the fixing roller (1) as described above.

Example 7

The procedure in Example 3 is repeated except for replacing the pitch-based carbon fiber with a PAN-based carbon fiber TORAYCA® Milled Fibers MLD-30 (from Toray Industries, Inc.). Thus, a fixing roller (7) is prepared. The fixing roller (7) is subjected to the same evaluations as the fixing roller (1) as described above.

Comparative Example 1

The procedure in Example 1 is repeated except for replacing the two-liquid-type addition-hardening fluorosilicone rubber with a two-liquid-type addition hardening silicone rubber DY35-2083 (from Dow Corning Toray Co., Ltd.). Thus, a fixing roller (8) is prepared. The fixing roller (8) is subjected to the same evaluations as the fixing roller (1) as described above.

Comparative Example 2

The procedure in Example 1 is repeated except that a primer is spray-coated on a surface of the elastic layer which has been subjected to the vulcanization, followed by natural drying for 30 minutes and covering with a PFA tube having a thickness of 30 μm. The resultant body is heated to 200° C. for 4 hours. Thus, a fixing roller (9) is prepared. The fixing roller (9) is subjected to the same evaluations as the fixing roller (1) as described above.

The compositions and evaluation results of the above-prepared fixing rollers are shown in Tables 1 to 3.

TABLE 1

| | Compositions (parts by weight) | | | |
|---|---|---|---|---|
| | Fluorosilicone Rubber | Silicone Rubber | Pitch-based Carbon Fiber | PAN-based Carbon Fiber |
| Example 1 | 100 | — | 40 | — |
| Example 2 | 100 | — | 40 | — |
| Example 3 | 100 | — | 40 | — |
| Example 4 | 100 | — | 40 | — |
| Example 5 | 100 | — | 40 | — |

TABLE 1-continued

| | Compositions (parts by weight) | | | |
|---|---|---|---|---|
| | Fluorosilicone Rubber | Silicone Rubber | Pitch-based Carbon Fiber | PAN-based Carbon Fiber |
| Example 6 | 100 | — | 40 | — |
| Example 7 | 100 | — | — | 40 |
| Comparative Example 1 | — | 100 | 40 | — |
| Comparative Example 2 | 100 | — | 40 | — |

TABLE 2

| | Release Layer | Void Ratio (%) | Ten Point Height Rz (μm) |
|---|---|---|---|
| Example 1 | — | 33 | 4.6 |
| Example 2 | — | 17 | 4.2 |
| Example 3 | Rubber | 33 | 3.5 |
| Example 4 | Rubber | 50 | 3.8 |
| Example 5 | Rubber | 67 | 4.4 |
| Example 6 | Rubber | 75 | 7.1 |
| Example 7 | Rubber | 33 | 3.7 |
| Comparative Example 1 | — | 33 | 4.5 |
| Comparative Example 2 | PFA | 33 | 2.1 |

TABLE 3

| | Toner Releasability | Gloss Unevenness | Warm-up Time (sec) |
|---|---|---|---|
| Example 1 | B | A | 26 |
| Example 2 | B | B | 39 |
| Example 3 | A | A | 28 |
| Example 4 | A | A | 16 |
| Example 5 | A | B | 19 |
| Example 6 | A | B | 35 |
| Example 7 | A | A | 65 |
| Comparative Example 1 | C | C | 27 |
| Comparative Example 2 | A | C | 31 |

With regard to toner releasability, each of Examples 3 to 7 in which the release layer includes a fluorosilicone rubber has a good result. In Examples 1 and 2 each of which has no release layer, toner offset slightly occurs, but is not a problem in practical use. In Comparative Example 1 in which the release layer includes a silicone rubber, and carbon fibers and voids are exposed at the surface of the release layer, toner offset considerably occurs. The above results show that fluorosilicone rubbers, in particular, release layers including fluorosilicone rubbers, improve toner releasability. Comparative Example 2 in which the release layer includes a PFA also has good toner releasability.

The ten point height Rz, which represents surface roughness, is likely to increase as the amounts of carbon fibers and voids exposed at the surface increase. By providing a release layer including a fluorosilicone rubber, the ten point height Rz can be reduced. However, in Example 6, despite the release layer including a fluorosilicone rubber, the ten point height Rz cannot be reduced because the void ratio is too large. As a result, gloss of the resultant fixed image is uneven. Also, gloss is uneven in Examples 2 and 5, but is not a problem in practical use. In Comparative Example 1, the resultant image quality is poor because of the occurrence of toner offset. In Comparative Example 2, gloss is uneven because the resultant fixed image has a rough surface like an orange peel. Such unevenness in gloss is considered to be caused because the release layer including PFA cannot follow the surface profile of paper, causing pressure difference when the image is fixed.

With regard to warm-up time, a time required to heat the fixing roller to 160° C. is 40 seconds or less in Examples 1 to 6. Accordingly, it is to be said that the warm-up time can be shortened when the void ratio is 15% or more. When the void ratio is less than 15%, a much longer time is required to heat the fixing roller to 160° C. In Example 7 in which a PAN-based carbon fiber is included, a long time is required despite the fact that the void ratio is 33%. This is because the PAN-based carbon fiber is poor at increasing thermal conductivity.

Accordingly, exemplary embodiments of the present invention provide a fixing member which has high toner releasability and short warm-up speed. In addition, exemplary embodiments of the present invention provide a fixing device and an image forming apparatus which produce high quality images.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2008-298826 and 2009-122424, filed on Nov. 21, 2008 and May 20, 2009, respectively, the entire contents of each of which are herein incorporated by reference.

What is claimed is:

1. A fixing member, comprising a substrate; and an elastic layer provided on a surface of the substrate, wherein the elastic layer comprises a fluorosilicone rubber including carbon fibers and voids and wherein the fluorosilicone rubber includes a fluoro-organosiloxane unit having the following formula (1):

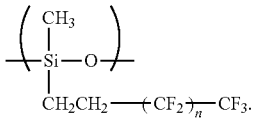

(1)

2. The fixing member according to claim 1, wherein neither the carbon fiber nor the void is exposed at a surface of the elastic layer.

3. The fixing member according to claim 1, further comprising a release layer comprising a fluorosilicone rubber on a surface of the elastic layer.

4. The fixing member according to claim 1, wherein the elastic layer includes no rubber other than the fluorosilicone rubber.

5. The fixing member according to claim 1, wherein the carbon fibers are pitch-based carbon fibers.

6. The fixing member according to claim 1, wherein the elastic layer has a void ratio of from 15 to 85%.

7. An image forming method, comprising:

forming a toner image on a recording medium with a toner; and fixing the toner image on the recording medium with the fixing member according to claim 1, wherein a ten point height Rz (μm) of roughness profile of a surface of the elastic layer which contacts the recording medium is smaller than a volume average particle diameter of the toner.

8. The fixing member according to claim 1, wherein a ten point height Rz (μm) of roughness profile of a surface of the elastic layer which contacts a recording medium is 5 μm or less.

9. A fixing device configured to fix a toner image on a recording medium, comprising:

the fixing member according to claim 1; and a pressing member pressed against the fixing member.

10. An image forming apparatus, comprising:

a toner image forming device configured to form a toner image; and the fixing device according to claim 9.

* * * * *